United States Patent [19]

Kristensson

[11] 4,236,694

[45] Dec. 2, 1980

[54] MANUAL WINCH WITH SAFETY CLUTCH, ESPECIALLY AS A POWER SOURCE IN NURSING FOR LIFTING PATIENTS

[75] Inventor: Nils L. O. Kristensson, Stockholm, Sweden

[73] Assignee: Landstingens Inkopscentral Lic, Ekonomisk Forening, Solna, Sweden

[21] Appl. No.: 967,144

[22] Filed: Dec. 6, 1978

[30] Foreign Application Priority Data

Dec. 8, 1977 [SE] Sweden ..... 7713950

[51] Int. Cl.[3] ..... B66D 1/00

[52] U.S. Cl. .....254/365; 254/376

[58] Field of Search ..... 254/167, 186 R, 186 HC, 254/187 R, 187 A, 187 B, 150, 190 R; 74/475, 523, 527, 528

[56] References Cited

U.S. PATENT DOCUMENTS

| | | | |
|---|---|---|---|
| 3,224,735 | 12/1965 | Linde | 254/167 |
| 3,248,087 | 4/1966 | Hallen | 254/167 |
| 3,640,505 | 2/1972 | Durand | 254/150 |
| 3,741,528 | 6/1973 | Profet | 254/190 R |
| 3,765,652 | 10/1973 | Janik | 254/167 |
| 4,156,521 | 5/1979 | Harman | 254/167 |

*Primary Examiner*—Leonard D. Christian

*Attorney, Agent, or Firm*—Cushman, Darby & Cushman

[57] ABSTRACT

A winch operated by a manual crank and handle for reeling-up or out a belt or rope and including a holding catch for preventing reeling-out when the handle is not actuated. A friction coupling mechanism is momentarily released when the handle is moved in the reeling-out direction, resulting in that the load is moved downwardly and actuates a screw mechanism which momentarily locks the coupling if the handle is stopped. Reeling-out is thus effected by releasing and locking actions following each other at very small intervals, the reeling-out movement being practically synchronous with the movement of the handle until it is stopped.

3 Claims, 14 Drawing Figures

FIG.5
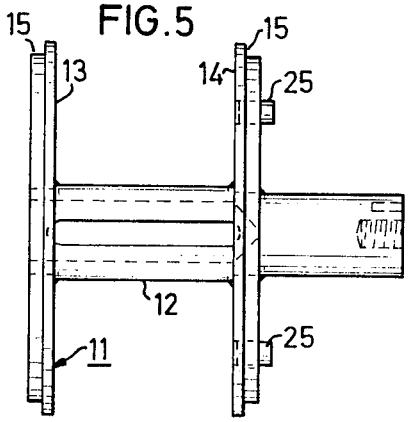
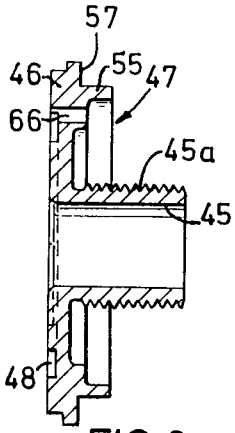
FIG.6
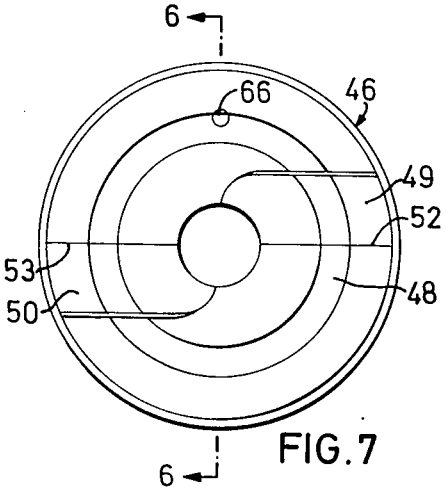
FIG.7
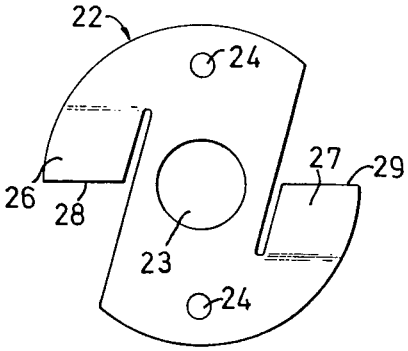
FIG.8
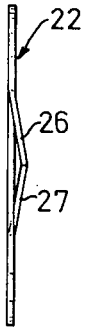
FIG.9

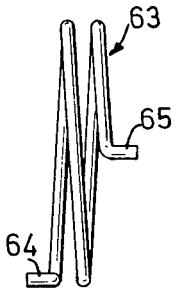
FIG.10
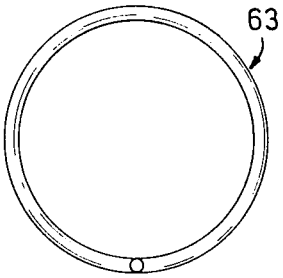
FIG.11
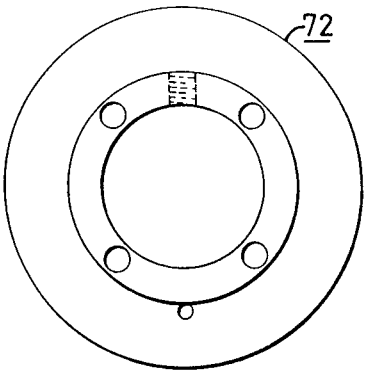
FIG.12
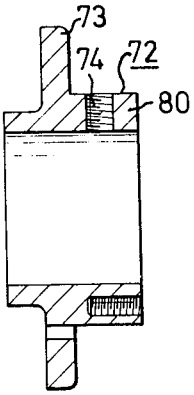
FIG.13
FIG.14
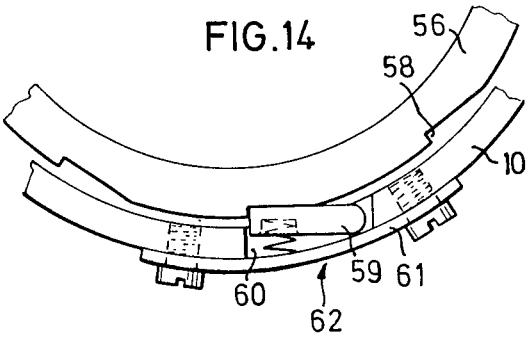

MANUAL WINCH WITH SAFETY CLUTCH, ESPECIALLY AS A POWER SOURCE IN NURSING FOR LIFTING PATIENTS

The present invention relates to a manual winch, primarily intended as a servo motor or power means in nursing to provide the hoisting force for lifting patients. The winch can also be used for lifting objects.

In nursing, different types of power means are used to ease the work of lifting patients. Hydraulic or pneumatic power cylinders are used in many cases as well as jacks operating mechanically or electrically. In some cases manual winches are used instead, in combination with gear means for obtaining the necessary force. The advantages with manual winches are, inter alia, that they can be manufactured relatively cheaply and simply and that they are functionally reliable. The winch has a reel for reeling in and out the belt or rope carrying the load, and is operated with the aid of a crank. When the reel is turned in the reeling-in direction, there are no difficulties in preventing counter-rotation, which can be taken care of with the aid of a holding catch, e.g. a spring-loaded pawl coacting with ratchet teeth to prevent rotation in one direction. It is, however, considerably more difficult to simply and positively control reeling-out from the reel under load. In some cases it is necessary to hold against the load with the crank or with a separate brake when lowering a load, entailing considerable risks if the grip on the crank should be lost. If this should happen, the load can unintentionally continue its movement downwards and quite possibly cause an accident.

The object of the present invention is therefore to provide a manual winch which can be put together in a simple way from comparatively cheap details to form a reliable winch, which is braked to a standstill without extra measures as soon as the crank is not actuated, and which can be turned in one or other direction solely by cranking in one or other direction.

This is achieved by a manual winch which, in accordance with the invention, has the distinguishing features set forth in the following claims.

In an especially suitable embodiment of the invention, the winch is provided with an extra safety catch functioning as a one-way clutch and so arranged that when the load approaches a bottom position with sufficient belt or rope withdrawn from the reel for it to be unloaded, the catch causes the reel to remain stationary even if there is continued rotation of the crank in the unreeling direction. The belt or rope is thus prevented from being completely wound off in an unloaded state from the reel, and also from being wound up again on the reel in the wrong direction. If the belt or rope were to be wound up in the wrong direction, the capacity of the winch for automatic braking while under load would be nullified, resulting in that the load could fall freely if the crank were released.

The details and advantages distinguishing the invention will now be more closely explained while referring to an embodiment of the winch according to the invention, shown on the accompanying drawings.

Figure 4:
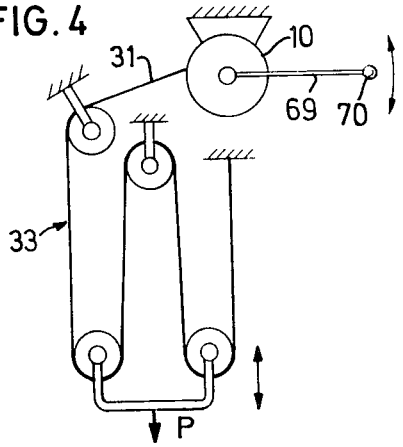

FIG. 4 schematically shows the winch in combination with a power increasing mechanism, FIG. 5 is a detail of the reel pertaining to the winch, FIG. 6 is a section along the line 6—6 in FIG. 7 through a clutch portion, FIG. 7 is an end view of the clutch portion in FIG. 6, FIG. 8 shows a detent disc in the extra safety catch coacting with the coupling portion in FIGS. 6 and 7, FIG. 9 is a side view of the detent disc in FIG. 8, FIG. 10 is a side view of a helical torsion spring, FIG. 11 is an end view of the helical torsion spring, FIG. 12 is a view of a clutch hub, FIG. 13 is a section along the axis of the hub in FIG. 12, and FIG. 14 is a detail of a holding catch functioning during the normal operating conditions of the winch.

The winch shown in FIGS. 1–4 consists of two main parts, which each comprises a number of assembled details and which have been put together and locked to each other to form the winch.

In one main part there is included a cylindrical housing 10, which can be quite simply manufactured by cutting off a metal tube to the length of the housing.

A winding reel 11 is accommodated in the housing, and consists of a hollow barrel 12 on which have been welded two circular end walls 13,14. Grooves 15 (FIG. 5) have been provided in the circumferences of the end walls for bearing balls 16 (FIG. 3), rolling against the inside of the cylindrical housing. The rotatably mounted reel is retained axially by two locking rings 17,18, inside these there being respectively a cover plate 19 and a bearing ring 20 to guide the balls.

At the inner end wall 14 the barrel 12 is provided with a shaft extension 21. There is a detent disc 22 (FIGS. 3,8,9) of resilient material, and having a central hole 23 for mounting it on the shaft 21. The disc is also provided with two diametrically opposed locating holes 24 (FIG. 8) fitting dowels 25 (FIGS. 3,5) on the end wall 14 for locking the disc against rotation relative thereto. The disc 22 (FIGS. 8,9) is further provided with two detent flaps 26,27 diametrically opposite each other, which are outwardly bent away from the end wall in FIG. 3, each flap having a radial abutment edge 28,29 to form the pawls in an extra safety catch or clutch means 30, which will be described below.

A belt 31 (FIGS. 1,3,4) is wound onto the barrel 12, and taken out through an opening 32 in the housing, this belt being intended to carry a load, preferably via a power reducing device enabling relatively large forces to be obtained manually, e.g. for lifting a patient or an object. An example of such apparatus 33 can simply consist of a number of pulleys arranged in accordance with FIG. 4 to provide mechanical power reduction conventionally. (FIG. 3) and this loop is inserted through a slit 35 in the barrel 12 for locking on the other side by means of a rod 36, to prevent the belt from being pulled off.

A locking screw with a shank 37 and head 38 is screwed into the housing to fix the position of the housing when mounted in a support. In the example shown, the support for the winch has two parallel walls 39,40 (FIG. 3) and a transverse wall 41, i.e. a conventional U-shaped section. There are openings 42,43 in the parallel walls for accommodating the housing in the position shown in FIG. 3. In this position the threaded hole for the removed set screw 37,38 is directly opposite a hole 44 in the transverse wall 41, so that when the screw is screwed into the housing, its head 38 is in the opening 44 and retains the housing in the support against both axial and rotational movement.

When the other main part of the winch has been assembled, it is mounted on the shaft extension 21 as a unit by means of an inner sleeve 45 incorporated in it, this sleeve being rotatably mounted on the shaft extension 21. The sleeve 45 has an outside right hand thread 45*a*, and at its inner end it is formed with a circular flange 46 (FIGS. 3,6,7) intended to be situated in the vicinity of the inner end wall 14 of the reel. Under normal conditions, when the belt 31 is loaded, the sleeve 45 and circular flange 46 form a clutch portion 47 which is drivably connected to the end wall 14 as though it were rigidly connected thereto, i.e. as though the shaft extension 21, sleeve 45, circular flange 46 and end wall 14 were made in one piece. Such a rigid connection would however involve certain risks if anyone attempted to wind up the belt in the wrong direction, i.e. by turning the crank 69 anti-clockwise in FIG. 1, instead of the normal clockwise direction.

Figure 3:
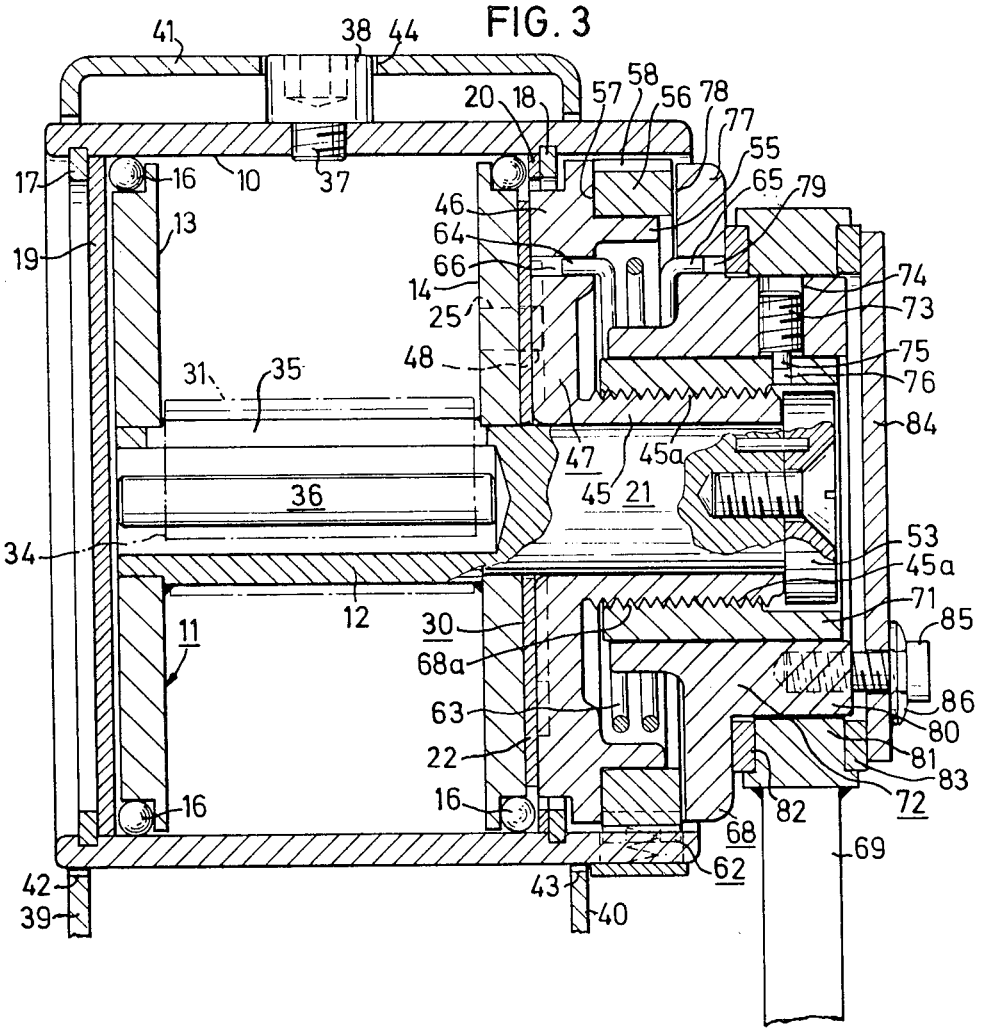
FIG. 3 is an axial section through the winch.

As is apparent from FIG. 7, the clutch portion 47 formed by the sleeve 45 and circular flange 46 is provided with a circular recess 48 on its surface facing towards the end wall 14 in FIG. 3, to accommodate the ends of the dowels 25 projecting from the end wall 14.

This surface of the circular flange is also provided with two recesses 49,50 (FIG. 7) intended for receiving the detent flaps 26,27 of the detent disc 22.

Each recess has an abutment edge 53,52, normal to the flange, and on the same diameter as is apparent from FIG. 7.

When the clutch portion 47 is accommodated on the shaft extension 21 in the position shown in FIG. 3, and is kept in engagement against the detent disc 22 with the aid of a retaining plate 53 screwed onto the end of the shaft extension, the detent disc 22 will have a small clearance between the end wall 14 and the circular flange 46, as shown in FIG. 3. The detent disc 22 is non-rotatably connected to the end wall 14 by the dowels 25. If the clutch portion 47 is rotated in the normal reeling-in direction when the belt 31 is loaded, i.e. anti-clockwise in FIG. 7, the flaps 26, 27 will snap down into their respective recesses 49,50 and the respective pairs of abutment edges on the detent flaps 26,27 and the recesses 49,50 will engage, i.e. edge 28 engages edge 52 and edge 29 engages edge 53. Since the belt 31 is loaded, the reel is biased to turn in the reeling-out direction when the crank is turned clockwise in FIG. 4.

On the other hand, if the belt 31 is unloaded and the reel is stationary, turning the clutch portion 47 in the reeling-out direction will cause the clutch portion 47 to be turned anti-clockwise in FIG. 3 in relation to the stationary detent disc 22, the detent flaps 26,27 being drawn out of the recesses 50,49 and snapping past the abutment edges 52, 53 each time these pass. The clutch means 30 can thus provide a free wheel action of great practical importance, as will be seen below.

In the vicinity of its outer edge, the circular flange 46 is provided with a cylindrical flange 55 for rotatably mounting a friction collar 56. One end surface of the collar 56 engages an annular abutment surface 57 on the circular flange 46 and is kept pressed against it by an axial force which provides a predetermined amount of friction, there being provision for increasing this force to increase the friction such that necessary torque for turning the reel under load can be transferred via the collar as is described below.

Along its circumference the collar 56 is provided with ratchet teeth 58 (FIGS. 3,14) and these coact with a spring loaded pawl 59 mounted in an opening 60 in the housing 10 and kept in place by means of a retaining strap 61 attached to the housing. The holding catch 62 thus obtained acts so that the pawl 59 engages one of the teeth 58 when the collar 56 is loaded for rotation in the reeling-out direction, while the pawl snaps over the teeth when the collar 56 is turned in the opposite direction, i.e. in the reeling-in direction.

Figure 2:
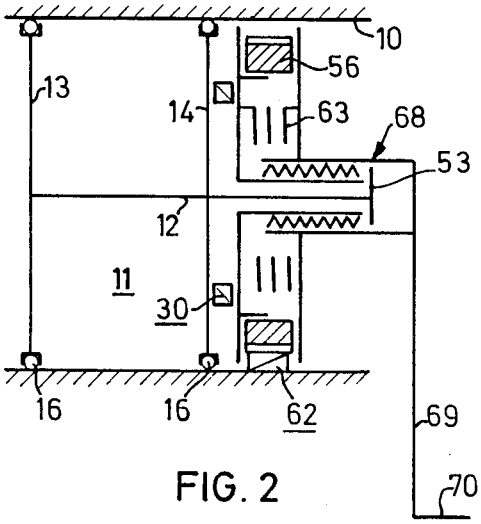
FIG. 2 is a much simplified sketch of the invention.

As is apparent from FIG. 2, there is a pretensioned helical torsion spring 63 (FIGS. 3,10,11) with axially directed ends 64,65. One end 64 is inserted in and fastened in a hole 66 in the circular flange 46.

Figure 1:
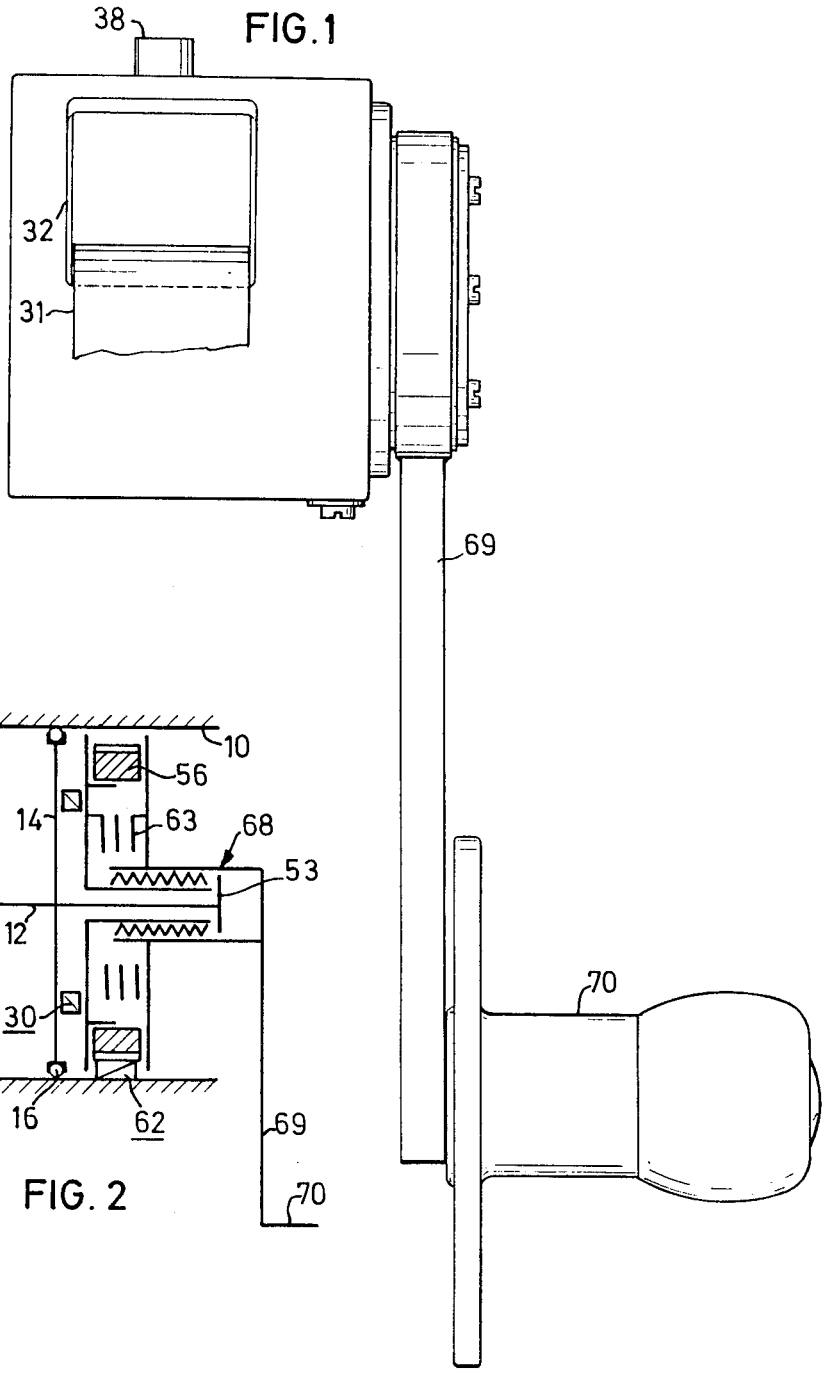
FIG. 1 is a side view of the winch according to the invention.

In the other main part there is further included in the embodiment shown a hub 68, primarily consisting of two separate parts, although it may be made in one piece as shown in FIG. 2, and provided with a crank 69 having a handle 70 as shown in FIGS. 1 and 2.

The hub 68 of FIG. 3 is provided with an inside right-hand thread 68*a* and is screwed onto the thread 45*a* of the inner sleeve 45 as shown in FIG. 3.

However, it is more advantageous to have the hub made of two parts as shown in FIG. 3, to facilitate assembly of this main part, especially with regard to the simplicity of assembling and pretensioning the spring 63 thus afforded.

The hub 68 consists of a journalling sleeve 71, internally provided with thread 68*a* for coaction with the thread 45*a* of the sleeve 45. A hub portion 72 is mounted rotatably and axially displaceable on the journalling sleeve 71, said hub portion, however, being locked in the desired position on the sleeve 71 by means of a set screw 73, which can be screwed into a threaded hole 74 in the hub portion, so that its pin-shaped end 75 is inserted in one of the four holes 76 at even pitch in the journalling sleeve 71.

The hub portion 72 has a radial flange 77, one side of which forms an annular abutment surface 78 for the collar 56.

The radial flange 77 is provided with a hole 79 for fixing the other end 65 of the helical torsion spring 63, the pretensioning of the spring being such that it strives to screw the journalling sleeve 71 further on to the inner sleeve 75, thus causing a predetermined initial pressure on the end surfaces of the collar 56 and thereby an initial friction at these surfaces.

The hub portion 72 is furthermore provided with a cylindrical end portion 80 for rotatably mounting a ring 81, to which the crank 69 with its handle 70 is attached. The ring 81 is disposed between two friction rings 82,83 and is kept pressed against the flange 77 by means of a pressure plate 84, which is tightened against the ring 83 to an optional pressure by means of four screws 85 with spring washers 86. The flange 77, friction rings 82,83, ring 81 and plate 84 thus form a safety coupling, which slips when the crank 69 meets a resistance above a predetermined amount. When there is the risk of the winch being subjected to excess loading, it is suitable to have such a safety coupling, but in certain cases it is not necessary, and then the crank 69 can be fastened directly to the cylindrical end portion 80 of the hub portion.

When the winch is stationary and the belt 31 is loaded, the tension in the belt will be transferred via the clutch means 30 to the circular flange 46 with its inner sleeve 45 to screw, relatively speaking, this into the journalling sleeve 71 and the hub 68, which is acted on by the spring 63 to turn for screwing on to the inner sleeve 45. This causes an increased pressure of the respective side surfaces 18,78 of the hub 68 and circular flange 46 on the collar 56, which should then begin to rotate with the reel under the action of the load. However, the collar 56 is locked against such rotation by the holding catch 62 and the reel remains stationary when the crank is not actuated.

If the loaded belt is to be wound up on the barrel 12 of the reel, the crank 69 is turned clockwise in FIG. 4. This results in a tendency of the hub 68 and the journalling sleeve 71 to screw onto the inner sleeve 45, which in its turn causes an increased pressure against the collar 56 for transference of force to the circular flange 46, and from this via the clutch means 30 to the end wall 14 and the barrel 12 of the reel to turn it and wind up the belt until the cranking movement is stopped, the winch then being locked in its stationary position in the way described here.

On the other hand, if it is desired to withdraw the loaded belt 31 by reeling out from the barrel 12, this can be simply done by turning the crank anti-clockwise in FIG. 4 without any further measures, e.g. releasing any catches by hand. When the crank is turned in the reeling-out direction, this will namely result in a small "screwing-out" of the hub 68 and the journalling sleeve 71 on the inner sleeve 45 until the pressure on the collar 56 and thereby the friction against it is reduced to such an extent that the clutch portion 47 and the circular flange 46 can rotate relative to the collar 56. However, the load on the belt is transferred via the end wall 14 and clutch means 30 to the circular flange 46 and turns it a distance in the reeling-out direction. This movement is quicker than that of the crank, the inner sleeve 45 thus turning relative the journalling sleeve 71 to screw it in, resulting in that the journalling sleeve is returned to its original position. If the cranking movement in the reeling-out direction is stopped, there is an immediate frictional braking action against the collar 56 which is locked by the clutch means. If the crank is turned substantially continuously a number of turns in the reeling-out direction, there is an alternate decrease and increase of the pressure against the end surfaces of the collar with such small intervals that they are hardly noticeable. Reeling-out of the loaded belt thus takes place substantially synchronously with the cranking movement.

Finally, if the crank is turned in the reeling-out direction so far that the loaded belt reaches a bottom position where there no longer is a load on the belt, and if the cranking movement continues, this will not result in continued rotation of the reel in the reeling-out direction, which would result in continued withdrawal of the belt, possibly to the position where the entire belt has been reeled off. The continued rotation of the reel in the reeling-out direction would thus result in the belt being wound up in the wrong direction on the barrel 12. If this were to happen, it would result in the belt loading the reel for clockwise rotation, and this force would not be transferred to the holding catch 62 but would only be taken up by the crank 69. If this were then released, the load on the belt could draw it out freely. However, this risk is prevented in good time. As soon as there is no load on, the reel ceases and the reel stops, continued cranking will give the circular flange 46 greater relative anti-clockwise speed than the stationary reel, i.e. the end wall 14. The clutch means 30 will thus release the connection between these two parts so that the crank is turned without affecting the reel. The risk of accidents, happening if the belt is wound up with the reel turning in the wrong direction, is thus prevented.

Assembly of the first main portion has been described above.

In the assembly of the second main portion, the circular flange 46 is firmly clamped, e.g. in a chuck. The journalling sleeve 71 is then screwed on to the inner sleeve 45. The spring 63 and collar 56 are fitted, with the spring end 64 in its hole 66, and the hub portion 72 is fitted onto the journalling sleeve 71 and the spring end 65 secured in its hole 79 in the hub portion. The hub portion is turned to pretension the spring 63, and it is thereafter clamped together with the circular flange 46 against the collar to lock the spring in its pretensioned position. The journalling sleeve is now screwed into a position such that one of the holes 76 comes opposite the threaded hole 74, whereafter the set screw 73 is screwed in to lock the hub portion 72 to the journalling sleeve 71. If the safety clutch is used, the crank ring with its friction rings 82,83 are put into place and clamped by screwing down the pressure plate 84.

The second main portion obtained thus is entered on the shaft extension 21 and pushed into the housing so that the circular flange 46 comes into engagement against the detent disc 22 retained by the dowels 25 on the end wall 14. The second main portion is then locked in this position by screwing down the retaining plate 53 at the end of the extension shaft 21, this plate forming an abutment for the inner sleeve 45 simultaneously as it defines the outward end position of the journalling sleeve 71.

If the crank is attached directly to the hub portion 72, assembly is now complete, with the exception of fitting a covering plate, but if the winch is to be provided with a safety clutch, the crank ring 81 with friction rings 82,83 are fitted, and then the plate 84 is screwed down to clamp the crank ring.

What I claim is:

1. A winch for raising and lowering a load comprising: a winding reel for winding and unwinding a flexible load-supporting member, said reel including a barrel and two circular end walls connected to the barrel and an axially projecting shaft extension; an internally cylindrical housing surrounding said reel; means mounting the circumferences of said circular end walls for rotation against the inside of said housing; means locking said reel against axial displacement within said housing; a sleeve rotatable on said shaft extension, said sleeve having a circular flange portion provided with an axially facing annular abutment surface and said sleeve having an externally threaded portion; a hub having an internal thread engaged with the external thread on said sleeve and rotatable in either direction relative to said sleeve and said hub having an annular abutment surface facing said annular abutment surface on said sleeve; an annular friction collar rotatably mounted between said annular abutment surfaces and having opposite axially facing surfaces facing the respective abutment surface on said sleeve and on said hub; a helical torsion tension spring connected between said circular flange portion and said respective circular end wall for producing engagement of said annular abutment surfaces with said opposite axially facing surfaces of said friction collar with a predetermined amount of friction; a holding catch cooperating with said friction collar to prevent rotation of said reel in an unwinding direction and to permit rotation of said reel in the opposite direction; clutch means for connecting and disconnecting said circular flange portion with one of said circular end walls of said reel in a manner such that when said reel is unloaded and non-rotating said hub and said friction collar, clamped together by said spring, and said sleeve can rotate in the unwinding direction; whereby when rotation in a winding direction is imparted to said hub, the latter threads on to said shaft extension in a direction toward said reel, so that said hub will press said friction collar harder between said abutment surfaces and thereby provide transmission of torque due to friction to the reel via the collar, the latter thereby turning freely in relation to said catch; and whereby rotation imparted to said hub in the opposite direction results in a momentary easing of the pressure on said friction collar and consequently permits rotation of said reel under the action of the load on the flexible load-supporting member until the relative screwing movement caused thereby between said reel and said hub has returned said abutment surfaces into engagement against said collar with such pressure that said collar once again participates in the power transmission, and brakes or terminates rotation of said reel in the unwinding direction, the collar being subjected to such alternating pressures as long as said hub is rotated in the unwinding direction and the load-supporting member is loaded.

2. A winch as in claim 1 wherein said internal thread on said hub is provided on a journalling sleeve which is rotatable on said shaft extension, said hub further including an annular member surrounding and fixed to said journalling sleeve, said annular member having said abutment surface thereon and said torsion spring being connected to said annular member.

3. A winch as in claim 1 wherein said clutch means includes a detent disc of resilient material made with resilient detent flaps and disposed between the opposing surfaces of said circular flange and the adjacent circular end wall, the detent disc being non-rotatably attached to one of said opposing surfaces and having its detent flaps coacting with recesses with abutment edges in the other of said opposing surfaces so that the edges of the detent flaps abut the edges for torque transmission in one relative direction of rotation but disengage in the opposite direction.

* * * * *